US005671547A

United States Patent [19]

Truchet et al.

[11] Patent Number: 5,671,547

[45] Date of Patent: Sep. 30, 1997

[54] HAIR DRESSING ACCESSORY FOR A HAIR DRYER APPLIANCE

[75] Inventors: Paul Truchet, Gleize; Daniel Bontoux, Saint-Genis-Laval, both of France

[73] Assignee: SEB S.A., Ecully, France

[21] Appl. No.: 505,344

[22] PCT Filed: Dec. 27, 1994

[86] PCT No.: PCT/FR94/01537

§ 371 Date: Oct. 30, 1995

§ 102(e) Date: Oct. 30, 1995

[87] PCT Pub. No.: WO95/17836

PCT Pub. Date: Jul. 6, 1995

[30] Foreign Application Priority Data

Dec. 30, 1993 [FR] France ..... 93 15919

[51] Int. Cl.[6] ..... A45D 25/00

[52] U.S. Cl. ..... 34/96; 34/97

[58] Field of Search ..... 34/96, 97, 98

[56] References Cited

U.S. PATENT DOCUMENTS

| | | | |
|---|---|---|---|
| 1,948,167 | 2/1934 | Cornwell . | |
| 2,753,434 | 7/1956 | Storm, Jr. | 34/97 |
| 3,370,583 | 2/1968 | Teranishi . | |
| 3,840,030 | 10/1974 | Baker . | |
| 3,949,765 | 4/1976 | Vallis | 34/96 |
| 4,132,360 | 1/1979 | Lee, Jr. . | |
| 4,295,283 | 10/1981 | Tomaro . | |

FOREIGN PATENT DOCUMENTS

| | | | |
|---|---|---|---|
| 52-23457 | 2/1977 | Japan | 34/96 |
| PCT/EP92/02640 | 11/1992 | WIPO . | |

*Primary Examiner*—Henry A. Bennett
*Assistant Examiner*—Dinnatia Doster
*Attorney, Agent, or Firm*—Loeb & Loeb LLP

[57] ABSTRACT

An accessory (9) integral with the blowing extremity (8) of a hair dryer (1). The accessory is traversed by the air blown out of the hair dryer to dry the hair. The accessory includes elements intended to be in contact with the hair, such as rigid bristles (11) or fingers (12). The accessory is composed of vibrating means (13, 14) which cause the elements (11, 12) to vibrate during hair drying.

18 Claims, 4 Drawing Sheets

HAIR DRESSING ACCESSORY FOR A HAIR DRYER APPLIANCE

TECHNICAL FIELD

The invention relates to appliances for drying the hair.

PRIOR ART

Previously known appliances generally consist in drying hair by blowing air that is heated by means of a heater resistance.

Such appliances are often associated with removable accessories that are fixed to the blowing end of the appliance. These accessories make it possible to dry hair while preparing it for a particular type of hair dressing, for example waving it, giving it volume, etc.

The accessories often have hair dressing elements such as fingers or stiff bristles which come into contact with locks of wet hair and facilitate combing and separating stuck-together wet hair.

Nevertheless, the effectiveness of the drying operation depends to a large extent on the skill of the user in handling the appliance provided with the accessory, in particular when drying hair quickly over its entire length or when giving hair the desired amount of volume. In addition, the operation of drying and dressing one's own hair is more difficult because of the discomfort of the position of the arms.

That is why the present invention seeks to mitigate these drawbacks by proposing an appliance that facilitates and accelerates the drying of hair and that gives volume thereto without requiring any particular action from the user.

The invention thus seeks to provide an accessory secured to the blowing end of an appliance for drying hair, the accessory being organized to pass the air expelled from the appliance for drying hair, and including elements designed to come into contact with the hair such as fingers or stiff bristles.

SUMMARY OF THE INVENTION

According to the invention, this accessory is characterized in that it includes vibrator means for putting said elements into vibration while drying hair.

The term "vibrator means" is used to cover means that impart cyclical motion to the elements. For example, this may be vibration of very small amplitude, of the order of the thickness of the elements, or of amplitude equal to several times said thickness. In addition, the frequency of the vibration may vary over a wide range, e.g. being visible or invisible to the naked eye.

This vibratory motion of the fingers or of the stiff bristles facilitates penetration thereof into the hair and promotes unsticking of hair that is still wet. It increases the area of exchange between the air and the hair, particularly close to the roots, thereby facilitating and accelerating drying, giving rise to a natural bouffant hairstyle without special action by the user.

In addition, the drying appliance can be held so as to put the elements of the accessory into contact with the scalp by selecting blown air of an appropriate temperature. Under such circumstances, the vibration of the elements is imparted to the scalp, thereby massaging it.

The accessory may be removable or non-removable.

In an advantageous version of the invention, the vibrator means comprise a part mounted to rotate on a shaft secured to a wall carrying the elements, the shaft passing through points of the part other than its center of gravity, means being provided for setting the part into rotation about the axis of the shaft.

The part is thus mounted on an shaft so as to be unbalanced. During rotation of the part, this unbalance generates vibration of the wall supporting the shaft, which vibration is transmitted to the above-mentioned elements. The means for setting the part into rotation may be internal to the accessory or to the appliance and they may be of various kinds.

In a preferred version of the invention, the part is a fan free to rotate about the axis of the shaft and lying, at least in part, in the flow path of the blown air so as to be set into rotation thereby.

This version makes it possible to avoid providing the appliance or the accessory with special means for setting the part into rotation. In addition, the elements are put into vibration during stages when the heating appliance is in operation.

The invention also provides a hair dryer appliance characterized in that it includes an accessory of the invention as specified above.

BRIEF DESCRIPTION OF THE DRAWINGS

Other characteristics and advantages of the invention appear further from the following description of six preferred embodiments. In the accompanying drawings, given by way of non-limiting example.

BEST METHODS OF PERFORMING THE INVENTION

In the various embodiments below, identical elements are given the same references.

Figure 1:
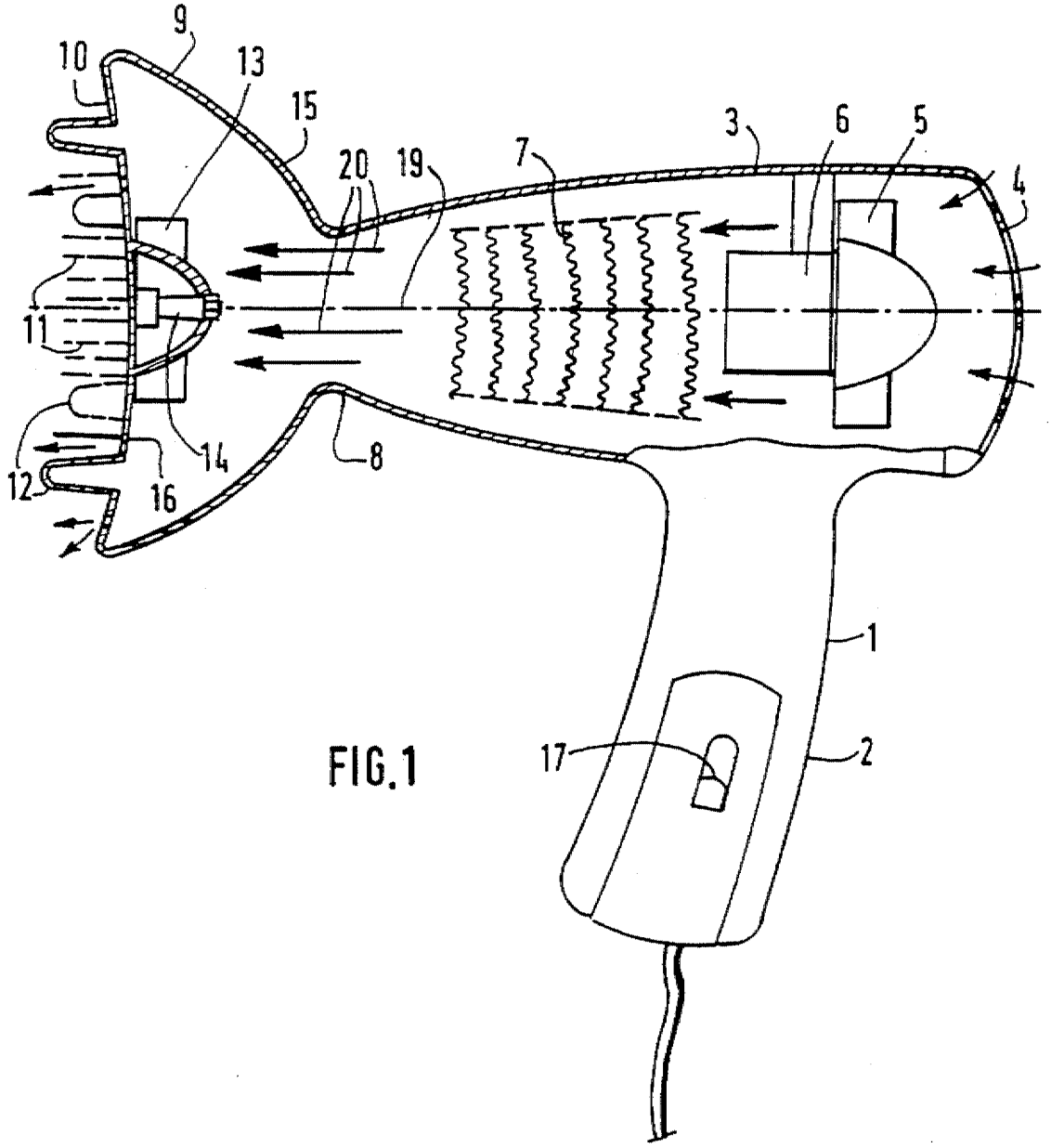
FIG. 1 is an axial section view in elevation through a hair dryer appliance provided with an accessory constituting a first embodiment of the invention.

FIG. 1 shows a first embodiment of the invention.

The hair dryer appliance 1 comprises a handle 2 secured to the body 3 of the appliance.

Along the body 3 which has an axis 19, the appliance conventionally comprises an inlet grid 4 for outside air, a fan 5 for propelling outside air into the body 3, a motor 6 for driving the fan 5 in rotation, and a heater resistance 7 for heating the air propelled by the fan 5. The heated air is directed towards the blowing end 8 of the appliance. A control knob 17 serves to switch on the motor 6. Means for regulating the temperature of the blown air are not shown and are conventional.

The end 8 is provided with a removable accessory 9 secured thereto. The accessory 9 is organized to have the air expelled from the appliance 1 pass therethrough for the purpose of drying hair. The general shape of the accessory 9 is to flare away from the blowing end 8 and its far end is defined by a wall 10. The wall 10 carries elements that are intended to come into contact with the hair, such as fingers 12 or stiff bristles 11. This configuration for an accessory is known.

According to the invention, the accessory 9 includes vibrator means for causing the elements 11, 12 to vibrate while drying the hair.

In this case, the vibrator means comprise a part 13 rotatably mounted on a shaft 14 secured to the wall 10 carrying the elements 11, 12, means being provided to cause the part 13 to rotate on the shaft 14. The shaft 14 passes through points of the part 13 other than its center of gravity so that the part 13 is not balanced on the shaft 14. This configuration may be obtained by placing the shaft 14 so that it does not pass through the geometrical center of the part 13, or else by causing the shaft 14 to pass through the geometrical axis while fixing a load on one side of the part 13.

In the present example, the part 13 is a fan that is free to rotate on the shaft 14 and that is disposed on the side of the wall 10 that faces the body 3. The shaft 14 extends parallel to the air flow direction and is substantially centered on said flow, being in alignment with the axis 19. The fan 13 thus lies on the path of the flow of blown air so as to be set into rotation thereby. Nevertheless, the fan could occupy a portion only of said flow path in order to be set into rotation by the blown air.

The fan 13 may be made of plastics material or of metal, for example.

The wall 10 carrying the fan 13 is connected to the body 3 of the appliance by a wall 15 made of a vibration-absorbing material, e.g. an elastomer.

The wall 10 has orifices 16 through which the blown air escapes.

The device as described above operates as follows.

The user actuates the knob 17 to switch on the motor 6. The blown air is heated by the resistance 7 and reaches the end 8 that carries the accessory 9, as shown by arrows 20.

The air propelled parallel to the shaft 14 carrying the fan 13 sets the fan into rotation. The unbalance of the fan 13 causes vibration in the shaft 14 and then in the wall 10. This vibration is transmitted to the bristles 11 and to the fingers 12 and imparts cyclical motion thereto which is substantially orthogonal to the axis 19.

While drying the hair, a user presses the accessory 9 into the hair. On coming into contact with the hair, the vibrating fingers 12 and bristles 11 penetrate therein and facilitate separation of the hair and drying along the entire length thereof. The vibrating elements 11 and 12 massage the scalp when the accessory is pressed gently against the head, in which case an appropriate temperature should be selected for the heated air.

The wall 15 absorbs the vibrations coming from the wall 10 so that no vibration is transmitted to the body 3 and to the handle 2.

Figure 2:
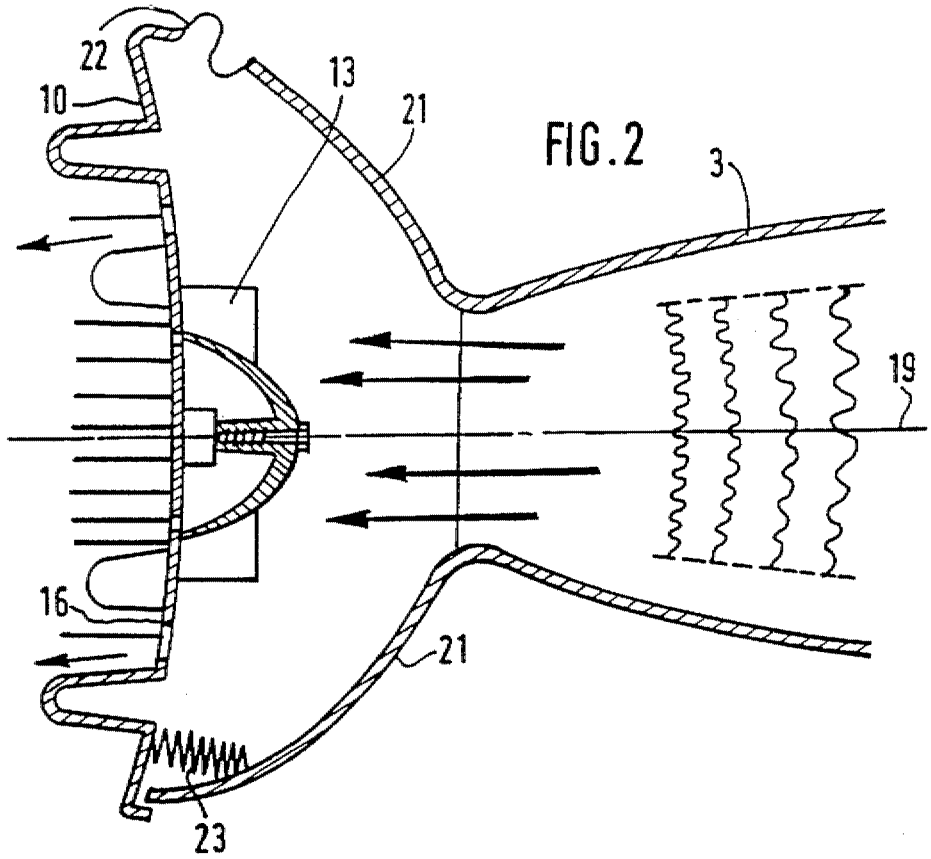
FIG. 2 is an axial section view in elevation showing a portion of the hair dryer appliance provided with an accessory of the invention, the top and bottom halves of the figure showing second and third embodiments of the invention, respectively.

The top half of FIG. 2 shows a second embodiment of the invention.

This time, the wall 21 connecting the accessory to the body 3 is a stiff wall, e.g. of plastics material. The wall 10 carrying the fan 13 is connected to the wall 21 via a flexible wall 22 that interconnects the walls 10 and 21. The flexible wall 22 made of rubber or of a suitable plastics material constitutes a bellows, for example.

This device is used in the same way as the preceding device. The wall 22 warps or flexes and thereby absorbs vibration of the wall 10, preventing it from being transmitted to the body 3.

The bottom half of FIG. 2 shows a third embodiment of the invention.

In this case, the flexible wall 22 is replaced by resilient damping means constituted, for example, by helical springs 23 or by rods made of a vibration-absorbing material, which means are disposed around the wall 10 and connected to the wall 21. Depending on the maximum stroke of the damper means carrying the wall 10, the wall 10 is disposed so as to be far enough away from the wall 21 to avoid striking it while it vibrates.

When the appliance 1 is in operation, the damping means 23 absorb the vibration of the wall 10 and prevent it being transmitted to the body 3.

Figure 3A:
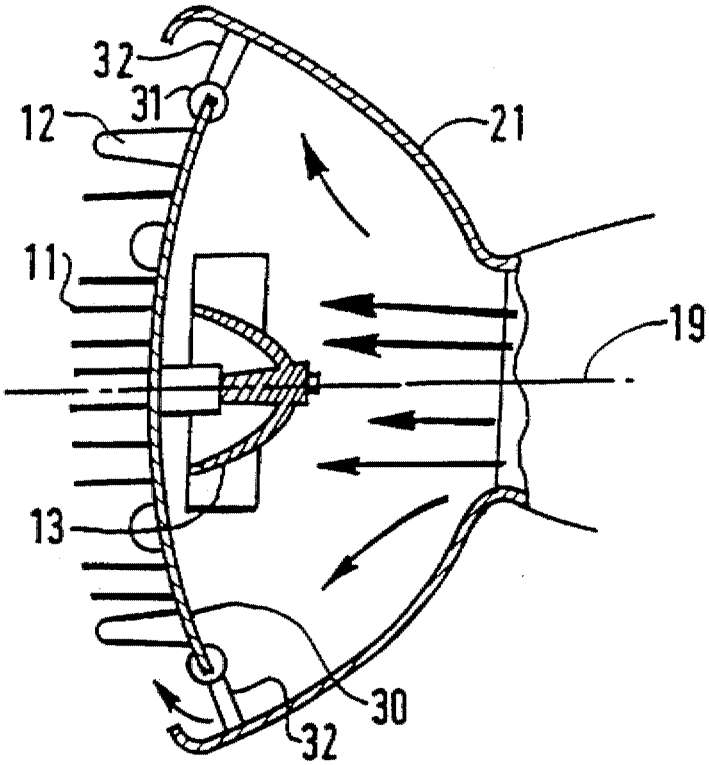
FIGS. 3*a* and 3*b* are axial section views in elevation of a portion of a hair dryer appliance provided with an accessory constituting a fourth embodiment of the invention.
Figure 3B:
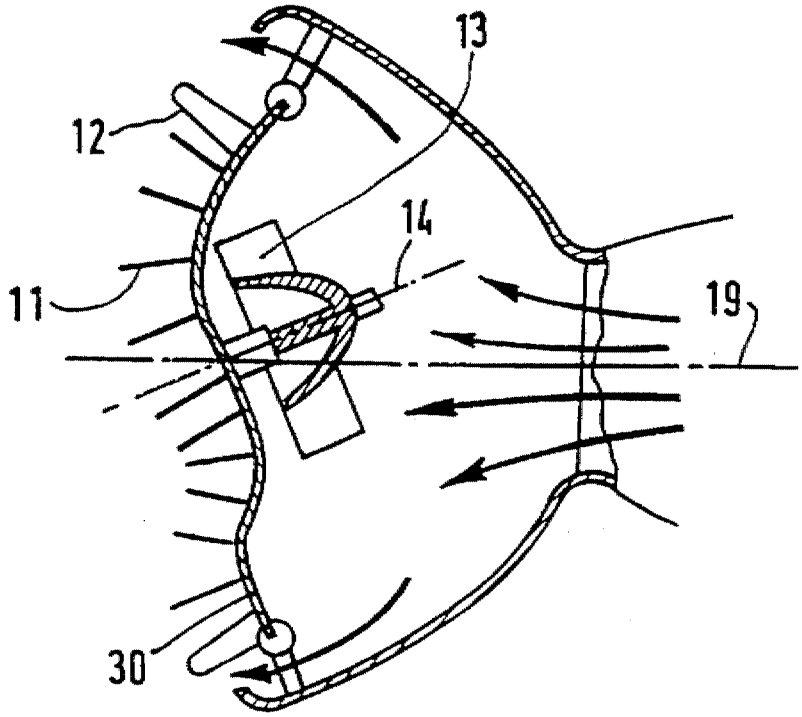

FIGS. 3*a* and 3*b* show a fourth embodiment of the invention.

In this device, the wall 30 which carries the elements 11 and 12 and the fan 13 is a continuous flexible wall, e.g. made of elastomer. It is held by a stiff circular frame 31 which is connected to the stiff wall 21 by a plurality of spokes 32 distributed around the frame 31. In this way, the wall 30 is connected in discontinuous manner via its edge to the wall 21 so that air can flow around said wall 30, between the frame 31 and the wall 21, between the spokes 32.

FIG. 3*b* shows the device in operation. As in the preceding embodiments, air coming from the body 3 causes the fan 13 to rotate. Since the wall is flexible, the unbalance of the fan 13 causes the shaft 14 to rotate perceptibly about the axis 19 of the appliance and causes the wall 30 to deform so that it flexes and warps. In FIG. 3*b*, the slope of the shaft 14 and the deformation of the wall 30 have been deliberately exaggerated.

This time, the elements 11 and 12 follow a path that is substantially conical in shape. The volume or bouffant effect imparted to the hair is increased by this embodiment, as is the massaging effect.

In a variant of this embodiment (not shown) the flexible wall 30 has openings through which air passes.

Figure 4:
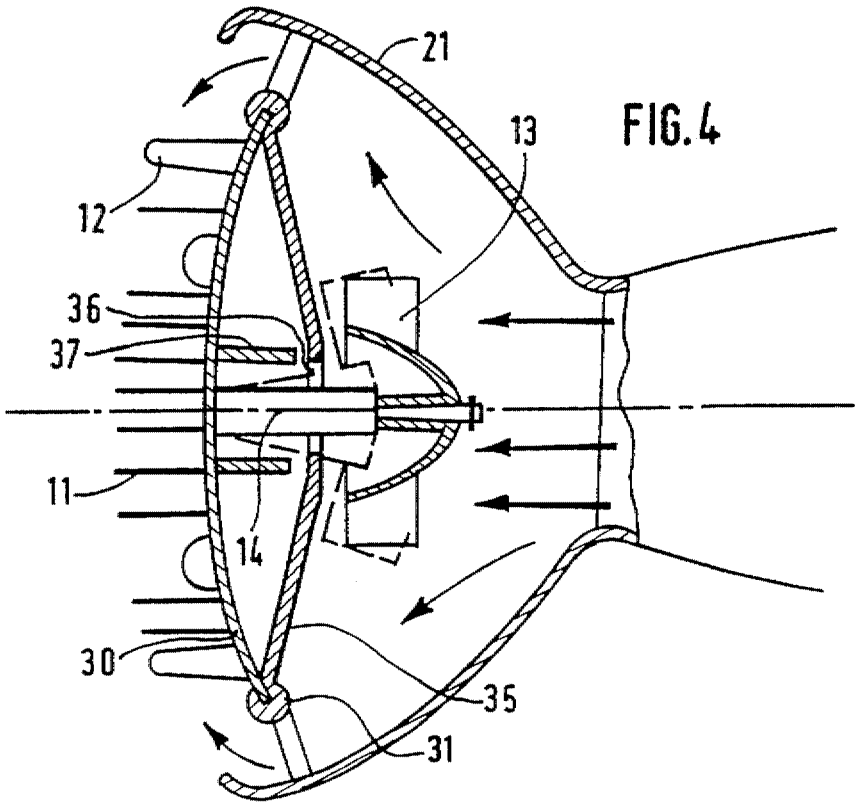
FIG. 4 is an axial section view in elevation of a hair dryer appliance provided with an accessory constituting a fifth embodiment of the invention.

FIG. 4 shows a fifth embodiment of the invention which constitutes another variant of the preceding embodiment.

The shaft 14 of the fan 13 is extended towards the body 3 so that the fan 13 is remote from the wall 30.

The accessory includes ring-forming means that are stationary relative to a stiff portion of the accessory, in this case the wall 21, and that are spaced apart from the flexible wall 30 in the flow direction.

The ring made in this way has its center substantially on the same axis as the shaft 14 and has a diameter that is substantially greater than the diameter of said shaft and that is substantially less than the diameter of the fan 13.

In the present example, the ring-forming means comprise a slightly curved stiff circular plate 35 extending between the fan 13 and the wall 30 and fixed via its edge to the frame 31. The plate 35 has a circular opening 36 in its center through which the shaft 14 passes. The opening is considerably larger in diameter than the shaft 14.

The accessory also includes means for preventing significant displacement of the fan 13 in the axial direction away from the ring-forming means. These means are constituted, in this case, by a ring 37 having the same axis as the shaft 14, fixed to the wall 30, and extending towards the plate 35 as far as the vicinity thereof. The inside diameter of the ring 37 is substantially greater than the diameter of the shaft 14.

When the appliance is in operation, the wall 30 deforms as in the preceding embodiment. However, the plate 37 limits lateral displacement of the fan 13 and of the shaft 14 which comes into abutment against the edge of the opening 36.

Because of the volume it occupies, the ring 37 maintains a minimum distance between the plate 35 and the wall 30 since, in the absence of the ring 37 or of analogous means, the fan 13 would tend to put the wall 30 into contact with the plate 35.

In this embodiment, the configuration of the plate 35 and of the ring 37 makes it possible to select the amplitude of the motion of the elements 11, 12.

Figure 5A:
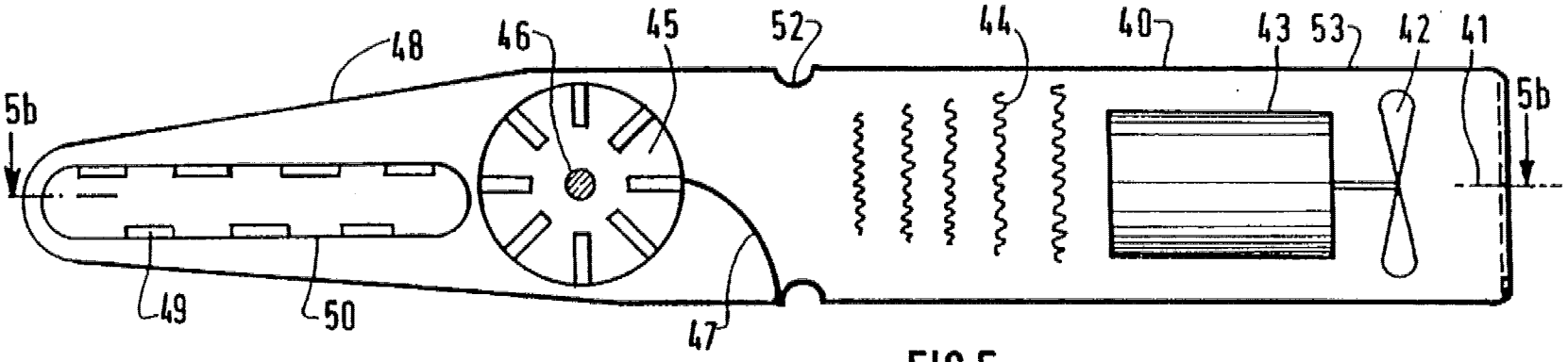
FIGS. 5*a* and 5*b* are axial section views of a sixth embodiment respectively on section lines 5*a*—5*a*, 5*b*—5*b* of FIGS. 5*b* and 5*a* respectively.
Figure 5B:
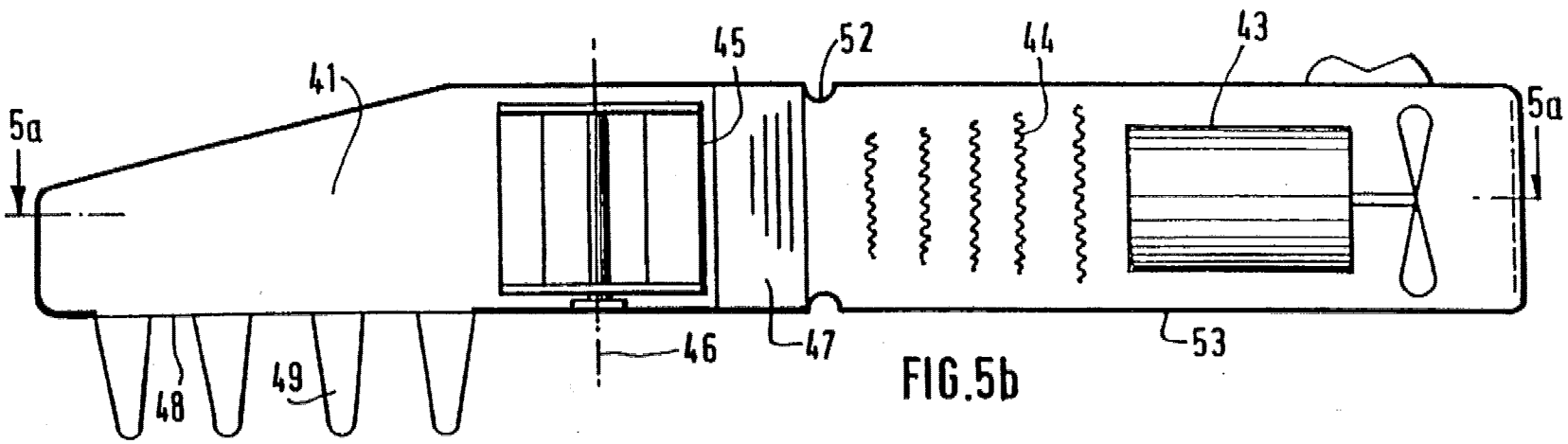

A sixth embodiment is shown in FIGS. 5*a* and 5*b*.

In this case, the appliance 40 is a hair dressing brush having an axis 41 and that is generally cylindrical or prismatic in shape, thereby making it possible, in particular, to dry and dress locks of hair in isolation from one another.

As in the preceding embodiments, the fan 42 driven by the motor 43 propels air towards the resistance 44. The vibrator means comprise a fan which is constituted in this case by a bladed wheel 45 whose geometrical axis is orthogonal to the flow direction. The fan 45 is mounted to rotate about an axis 46 in such a manner as to be unbalanced about said axis, as in the preceding embodiments.

A deflector 47 in the shape of a circular arc fixed to the wall of the appliance directs the flow of air heated by the resistance 44 towards that half of the fan 45 which is situated above the axis 46 in FIG. 5*a* so as to cause the fan 45 to rotate.

The accessory 48 of the appliance has fingers 49 on either side of an outlet orifice 50 for the blown air. The fingers extend in a direction orthogonal to the axis 41.

The air causes the fan 45 to rotate, thereby generating vibration in the fingers 49 as in the preceding embodiments.

A bellows 52 constitutes a vibration-absorbing membrane that prevents the vibration from being transmitted to the portion 53 of the appliance that comprises the handle thereof.

Naturally, numerous modifications and improvements can be applied to the invention without going beyond the ambit thereof.

In addition, the invention relates to appliances for drying hair, but it can also be applied to other fields. Thus, the invention may adventurously be used for drying and dressing the coats of animals. The term "hair" should therefore not be restricted to human hair.

SUITABILITY FOR INDUSTRIAL APPLICATION

The industrial application of the invention lies in providing an accessory for hair dryer appliances.

We claim:

1. An accessory (9, 48) secured to the blowing and (8) of a hair dryer appliance (1), the accessory being organized so that the air expelled from the hair dryer appliance passes therethrough, and including elements designed to come into contact with the hair, said elements being composed of fingers (12, 49) or stiff bristles (11), the accessory being characterized in that it includes vibrator means (13 14, 45, 46) for generating vibrations and transferring the vibrations to said elements (11, 12) while drying hair.

2. An accessory according to claim 1, characterized in that said vibrator means comprise a part (13, 45) mounted to rotate on a shaft (14, 46) secured to a wall (10, 30) carrying said elements (11, 12, 49), said shaft (14, 46) passing through points of the part (13, 45) other than its center of gravity, means being provided for setting the part (13, 45) into rotation about the axis of the shaft (14, 46).

3. An accessory according to claim 2, characterized in that said part is a fan (13, 45) free to rotate about the axis of the shaft (14, 46) and lying, at least in part, in the flow path of the blown air so as to be set into rotation thereby.

4. An accessory according to claim 3, characterized in that the wall (10) carrying the part (13) is connected to the body (3) of the appliance by a wall (15) made of a vibration-absorbing material.

5. An accessory according to claim 2, characterized in that the wall (10) carrying the part is connected to the remainder of the accessory by a flexible wall (22) or by resilient damper means (23).

6. An accessory according to claim 2, characterized in that the wall (10) carrying the part has outlet orifices (16) for the blown air.

7. An accessory according to claim 2, characterized in that the wall (30) carrying the part is a flexible wall.

8. An accessory according to claim 7, characterized in that the wall (30) carrying the part is connected in discontinuous manner via its edge to a stiff portion (21) of the accessory so that the air can flow around the periphery of said wall (30).

9. An accessory according to claim 7, characterized in that it further includes ring-forming means (35) that are stationary relative to a stiff portion (21) of the accessory and that are spaced apart from the flexible wall (30) in the flow direction, the ring having its center substantially on said axis of the shaft (14) and having a diameter that is perceptibly greater than the diameter of said shaft and perceptibly smaller than the diameter of the part, the accessory also including means (37) for preventing-perceptible displacement of the part (13) in its axial direction away from the ring-forming means.

10. In a hair dryer appliance (1) having a blowing end, the improvement comprising an accessory (9, 48) secured to said blowing end (8) of said hair dryer appliance (1), said accessory being organized so that air expelled from said hair dryer appliance passes through said accessory, said accessory including elements designed to come into contact with the hair, said elements being composed of fingers (12, 49) or stiff bristles (11), and said accessory further having vibrator means (13, 14, 45, 46) for generating vibrations and transferring the vibrations to said elements while drying hair.

11. An appliance according to claim 10, wherein said vibrator means comprise a part (13, 45) mounted to rotate on a shaft (14, 46) secured to a wall (10, 30) carrying said elements (11, 12, 49), said shaft (14, 46) passing through points of the part (13, 45) other than its center of gravity, and means for setting said part 13, 45) into rotation about the axis of the shaft (14, 46).

12. An appliance according to claim 11, wherein said part is a fan (13, 45) free to rotate about the axis of said shaft (14, 46) and lying, at least in part, in the flow path of the blown air so as to be set into rotation thereby.

13. An appliance according to claim 11, wherein said wall (10) carrying said part (13) is connected to said body (3) of said appliance by a wall (15) made of a vibration-absorbing material.

14. An appliance according to claim 11, wherein said wall (10) carrying said part is connected to the remainder of said accessory by a flexible wall (22) or by resilient damper means (23).

15. An appliance according to claim 11, wherein said wall (10) carrying said part has outlet orifices (16) for the blown air.

16. An appliance according to claim 11, wherein said wall (30) carrying said part is a flexible wall.

17. An appliance according to claim 16, wherein said wall (30) carrying said part is connected in a discontinuous manner via its edge to a stiff portion (21) of said accessory so that air can flow around the periphery of said wall (30).

18. An appliance according to claim 16, wherein said accessory further includes ring-forming means (35) that are stationary relative to a stiff portion (21) of said accessory and that are spaced apart from said flexible wall (30) in the flow direction, said ring having its center substantially on said axis of said shaft (14) and having a diameter that is perceptibly greater than the diameter of said shaft and perceptibly smaller than the diameter of said part (13), said accessory also including means (37) for preventing perceptible displacement of said part (13) in its axial direction away from said ring-forming means.

* * * * *